United States Patent [19]

Corbin

[11] 4,144,739

[45] Mar. 20, 1979

[54] WIRE DRAWING DIE AND METHOD OF MAKING THE SAME

[75] Inventor: Lawrence W. Corbin, Fort Wayne, Ind.

[73] Assignee: Fort Wayne Wire Die, Inc., Fort Wayne, Ind.

[21] Appl. No.: 841,886

[22] Filed: Oct. 13, 1977

[51] Int. Cl.[2] ..... B21C 3/02

[52] U.S. Cl. ..... 72/467; 76/101 A

[58] Field of Search ..... 76/107 A, 107 R, 101 B, 76/DIG. 12; 72/467

[56] References Cited

U.S. PATENT DOCUMENTS 2,171,323 8/1939 Wyland ..... 76/107 A

*Primary Examiner*—Harold D. Whitehead
*Assistant Examiner*—Roscoe V. Parker
*Attorney, Agent, or Firm*—Gust, Irish, Jeffers & Rickert

[57] ABSTRACT

A wire drawing die includes a metal casing having flat, parallel front and back sides. A first cylindrical cavity having a bottom wall is formed in the front casing side. A cylindrical metal plug having top and bottom ends is secured in the first casing cavity, the bottom end having a second, concentric cylindrical cavity formed therein. A cylindrical metal blank having opposite ends and a concentric core formed of a synthetic hard, wear-resistant material, such as polycrystalline aggregate of synthetic diamond or polycrystalline cubic boron nitride, is closely fitted in the second cavity with one end engaging the bottom thereof and the other end engaging the first casing cavity bottom wall. The top end of the plug and the back side of the casing have concentric countersunk openings therein respectively extending therethrough to the core, and the core has a concentric die opening therethrough communicating between the countersunk openings.

14 Claims, 3 Drawing Figures

FIG.1
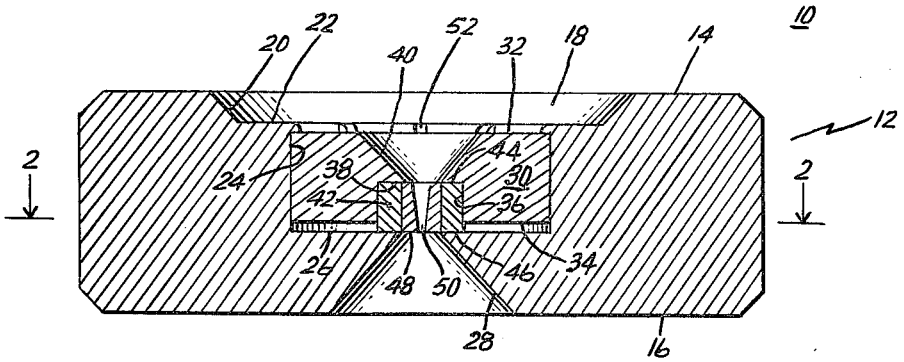
FIG.3
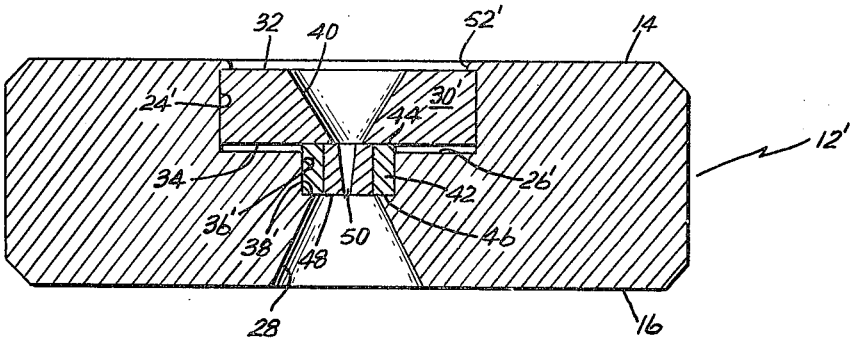
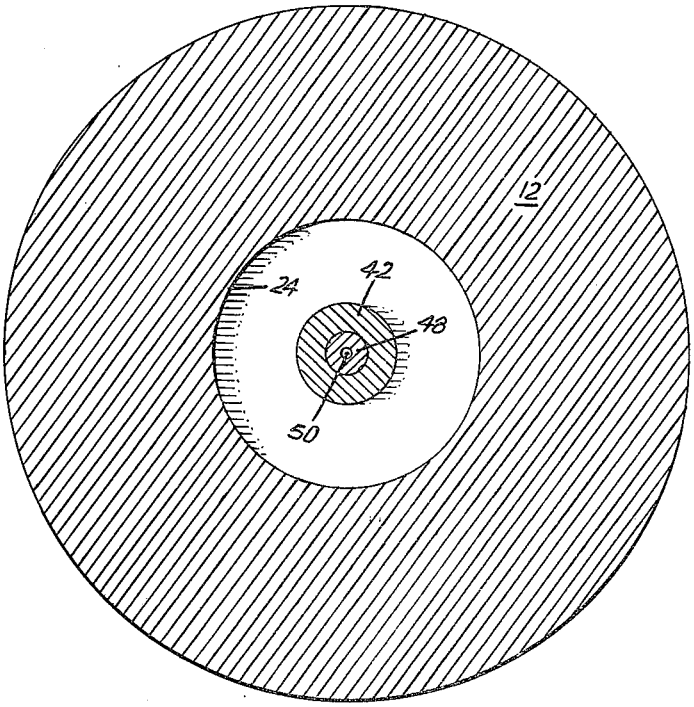
FIG.2

WIRE DRAWING DIE AND METHOD OF MAKING THE SAME

BACKGROUND OF THE INVENTION

1. Field of the Invention

This invention relates generally to wire drawing dies and methods of making such dies, and more particularly to a wire drawing die employing a synthetic hard, wear-resistant material and the method of making the same.

2. Description of the Prior Art

Natural diamond wire drawing dies have been manufactured for many years and typically comprise a metal casing in which the diamond is mounted, the casing in turn being adapted to be mounted in a wire drawing machine. U.S. Pat. No. 2,171,323 discloses one prior method of making a natural diamond wiring drawing die.

Polycrystalline aggregates of synthetic diamond have recently become available and an annular sintered tungsten carbide blank having a core of polycrystalline aggregate of synthetic diamond is sold by the General Electric Company under the trademark "Compax". In the past, wire drawing dies employing blanks having polycrystalline aggregate of synthetic diamond cores have been shrink-fitted in a cavity in the casing; however, such shrink-fitting of the blank has required a substantial amount of skilled labor and has resulted in excessive breakage of the synthetic diamond core. A plug is shrink-fitted in the casing cavity over the blank and has the usual countersunk opening formed therethrough to the core; however, during the process of machining, the countersunk opening may extend to the outside diameter of the plug and into the surrounding casing.

The General Electric Company has even more recently introduced another synthetic hard, wear-resistant material suitable for wire drawing dies, polycrystalline cubic boron nitride, referred to by the trademark "Borazon".

It is therefore desirable to provide a wire drawing die employing a synthetic hard, wear-resistant material, such as polycrystalline aggregate of synthetic diamond or polycrystalline cubic boron nitride, and a method of making the same which eliminates shrink-fiting of the blank in the casing, reduces breakage in the core, and eliminates the problem of the countersunk opening in the plug extending into the casing.

It has been common practice to secure a tungsten carbide wire drawing die in a casing cavity by crimping portions of the casing to engage the die.

SUMMARY OF THE INVENTION

The improved wire drawing die of the invention, in its broader aspects, comprises a metal casing having flat, parallel front and back sides with the front casing side having a first, cylindrical cavity formed therein, the first cavity having a bottom wall. A cylindrical metal plug is secured in the first casing cavity and has top and bottom ends. One of the first cavity bottom wall and the bottom plug end has a second cylindrical cavity formed therein concentric with the first cavity and having a bottom. A cyclindrical metal blank having opposite ends and having a concentric core formed of synthetic hard, wear-resistant material, such as polycrystalline aggregate of synthetic diamond or polycrystalline cubic boron nitride, is closely fitted in the second cavity with one end engaging the bottom thereof, and with the other end engaging the other of the first cavity bottom wall and bottom plug end. The plug top end and the casing back side have concentric countersunk openings therein respectively extending therethrough to the core, the core having a concentric die opening therethrough communicating between the countersunk openings.

In accordance with the method of the invention, in its broader aspects, the countersunk openings are machined in the plug and in the casing, respectively, the blank is positioned in the second cavity, and the plug is then secured in the first casing cavity.

It is accordingly an object of the invention to provide an improved wire drawing die.

Another object of the invention is to provide an improved method of making a wire drawing die.

A further object of the invention is to provide an improved wire drawing die employing a synthetic hard, wear-resistant material, such as polycrystalline aggregate of synthetic diamond or polycrystalline cubic boron nitride.

Yet another object of the invention is to provide an improved method of making a wire drawing die employing a synthetic hard, wear-resistant material, such as polycrystalline aggregate of synthetic diamond or polycrystalline cubic boron nitride.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWING

FIG. 1 is a cross-sectional view illustrating the improved wire drawing die of the invention;

FIG. 2 is a top cross-sectional view taken generally along the line 2—2 of FIG. 1; and FIG. 3 is a cross-sectional view illustrating a modified form of the improved wire drawing die of the invention.

DESCRIPTION OF THE PREFERRED EMBODIMENTS

Referring now to FIGS. 1 and 2 of the drawing, one form of wire drawing die of the invention, generally indicated at 10, comprises a cylindrical metal casing 12, preferably, but not necessarily, formed of stainless steel, having flat, parallel, front and back sides 14, 16. Relatively shallow, annular cavity 18 is formed in front side 14 of casing 12 and has tapered side wall 20 and flat bottom wall 22 parallel with front side 14. Cylindrical cavity 24 concentric with cavity 18 is formed in bottom wall 22, cavity 24 having a smaller diameter than cavity 18, and having bottom wall 26 spaced from back casing side 16 and parallel therewith. Countersunk opening 28 is formed in back casing side 16 concentric with cavities 18, 24, and extends to bottom wall 26 of cavity 24.

Cylindrical plug 30 having top and bottom ends 32, 34, has cylindrical cavity 36 formed in bottom end 34; cavity 36 has flat bottom 38. Countersunk opening 40 is formed in top end 32 of plug 30 and extends therethrough to bottom 38 of cavity 36.

Cylindrical blank 42 having top and bottom ends 44, 46 is closely fitted in plug cavity 36 with its top end 44 engaging bottom 38 thereof; blank 42 is slightly longer than the depth of plug cavity 36. Blank 42 may be of the type sold by the General Electric Company under the trademark "Compax". Blank 42 is typically formed of sintered tungsten carbide and has core 48 concentrically therein which may be formed of polycrystalline aggregate of synthetic, i.e., man-made diamond. Alternatively, core 48 may be formed of polycrystalline cubic boron nitride sold by the General Electric Company under the trademark "Borazon".

Plug 30, with blank 42 fitted in cavity 36, is closely fitted in cavity 24 with bottom end 46 of blank 42 engaging bottom wall 26 of casing cavity 24 and spacing bottom end 34 of plug 30 therefrom. Core 48 has die opening 50 therethrough communicating with countersunk openings 28, 40 and concentric therewith.

In the illustrated embodiment, top end 32 of plug 30 is spaced below bottom wall 22 of casing cavity 18, and plug 30 is secured in casing cavity 24 by crimping bottom wall 22 of cavity 18 at a plurality of points, as at 52. It will be readily understood that plug 30 may be secured in cavity 24 by other means, such as by being press-fitted therein or by brazing or welding.

It will now readily be seen that plug 30 is relatively wider and thinner than the plugs previsouly employed for mounting synthetic diamonds and thus, countersunk opening 40 does not extend to its periphery; cavity 18 in essence forms an extension of countersunk opening 40. It will further be seen that blank 42 is retained in cavity 36 in plug 30 without the necessity of heat-shrinking and thus, the breakage formerly encountered is minimized.

Referring now to FIG. 3 in which like elements are indicated by like reference numerals and similar elements by primed reference numerals, in certain applications, cavity 18 of the previous embodiment may not be necessary and further, the blank-retaining cavity may be formed in the casing rather than in the plug. Here, casing cavity 24' is formed in front side 14 of casing 12', and cavity 36' is formed in its bottom wall 26'. Blank 42 is closely fitted in cavity 36' with its bottom end 46 engaging bottom 38'.

Plug 30' is closely seated in casing cavity 24' with its bottom end 34 engaging top end 44 of blank 42 and being spaced thereby from bottom wall 36' of cavity 24'. Here, plug 30' is secured in cavity 24' by a continuous crimp 52'. As in the case of the previous embodiment, countersunk openings 28, 40 are formed in casing 12' and plug 30' prior to assembly; here, countersunk opening 28 extends to bottom 38' of cavity 36', and countersunk opening 40 extends to bottom end 34 of plug 30'. Die opening 50 communicates with countersunk openings 28, 40.

While there have been described above the principles of this invention in connection with specific apparatus, it is to be clearly understood that this description is made only by way of example and not as a limitation to the scope of the invention.

What is claimed is:

1. A wire drawing die comprising; a metal casing having flat, parallel front and back sides, said front casing side having a first cavity formed therein having a flat bottom wall, said first cavity having a cylindrical side wall extending from said front casing side to said bottom wall, a metal plug having top and bottom ends and a cylindrical outer surface extending between said ends, said plug being mechanically secured in said first casing cavity with a close, non-deforming fit, said bottom end being adjacent said bottom wall; one of said bottom end and bottom wall having a second cavity formed therein concentric with said first cavity and having a cylindrical side wall extending to a flat bottom; a metal blank having flat opposite ends and a cylindrical outer surface extending between said ends, said blank having a concentric core formed of synthetic hard, wear-resistant material, said blank being closely fitted in said second cavity with one end engaging the bottom thereof and with the other end of said blank engaging the other of said bottom end and bottom wall; said plug top end and casing back side having concentric countersunk openings therein respectively extending to said core, said core having a concentric die opening therethrough communicating between said countersunk openings.

2. The die of claim 1 wherein said second cavity is formed in said bottom end of said plug, and said other end of said blank engages said bottom wall of said first cavity.

3. The die of claim 1 wherein said second cavity is formed in said bottom wall of said casing, and said other end of said blank engages said bottom end of said plug.

4. The die of claim 1 wherein said front casing side has a third, relatively shallow, annular cavity formed therein concentric with said first and second cavities, said third cavity having a flat bottom wall with said first cavity being formed therein, said first cavity having a smaller diameter than said third cavity.

5. The die of claim 4 wherein said third casing cavity has a side wall which tapers outwardly from the bottom wall thereof to said front casing sides.

6. The die of claim 1 wherein said plug has an interference fit with said first cavity.

7. The die of claim 6 wherein said casing has means thereon for engaging said top end of said plug thereby to secure the same in said first cavity.

8. The die of claim 7 wherein said securing means comprises a crimped portion.

9. The die of claim 1 wherein said other end of said blank projects beyond said one of said bottom end and bottom wall thereby spacing the same from said other of said bottom end and bottom wall.

10. The die of claim 1 wherein said front casing side has a third, relatively shallow, annular cavity formed therein concentric with said first and second cavities, said third cavity having a flat bottom wall with said first cavity being formed therein, said first cavity having a smaller diameter than said third cavity, said third cavity having a side wall which tapers outwardly from the bottom wall thereof to said front casing wall, said second cavity being formed in said bottom end of said plug, said other end of said blank engaging said bottom wall of said first cavity, said other end of said blank projecting beyond said bottom end of said plug thereby spacing the same from said bottom wall of said first cavity, said plug having an interference fit with said first cavity, said top end of said plug being spaced below said bottom wall of said third cavity, said plug being secured in said first casing cavity by a portion crimped from said bottom wall of said third cavity.

11. The die of claim 1 wherein said synthetic material is chosen from the class consisting of polycrystalline aggregate of synthetic diamond and polycrystalline cubic boron nitride.

12. The method of making a wire drawing die comprising the steps of: providing a metal casing having front and back sides; forming a first cavity in said front casing side having a flat bottom wall and a cylindrical side wall extending from said front casing side to said bottom wall; providing a metal plug having flat top and bottom ends and a cylindrical outer surface extending between said ends; forming a second cavity in one of said first cavity bottom wall and said plug bottom end, said second cavity having a cylindrical side wall extending to a flat bottom; forming countersunk openings in said top end of said plug and said back side of said casing respectively concentric with said cavities and extending to said bottom of said second cavity and the other of said first cavity bottom wall and said plug bottom end; providing a metal blank having flat opposite ends and a cylindrical outer surface extending between said ends, said blank having a concentric core formed of synthetic hard, wear-resistant material and having a diameter to be closely fitted in said second cavity and a length at least as long as said second cavity; positioning said blank in said second cavity with one end of said blank engaging the bottom thereof; mechanically securing said plug in said first cavity with a non-deforming, close fit and with the other end of said blank engaging the other of said first cavity bottom wall and plug bottom end; and drilling a die opening in said core communicating between said countersunk openings and concentric therewith.

13. The method of claim 12 comprising the further step of forming a third, shallow annular cavity in said front casing side, said third cavity being concentric with said first and second cavities and having a flat bottom wall, said first cavity being formed in said third cavity bottom wall, said first cavity having a smaller diameter than said third cavity.

14. The method of claim 13 wherein said securing step comprises crimping a portion of said third cavity bottom wall to engage said top end of said plug.

* * * * *